US008760382B2

(12) United States Patent
Oh et al.

(10) Patent No.: US 8,760,382 B2
(45) Date of Patent: Jun. 24, 2014

(54) LIQUID CRYSTAL DISPLAY DEVICE AND METHOD FOR DRIVING THE SAME

(75) Inventors: Eui Yeol Oh, Gyeonggi-do (KR); Hee Jung Hong, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1060 days.

(21) Appl. No.: 11/319,787

(22) Filed: Dec. 29, 2005

(65) Prior Publication Data

US 2006/0164379 A1 Jul. 27, 2006

(30) Foreign Application Priority Data

Dec. 30, 2004 (KR) ..... 10-2004-0116345

(51) Int. Cl.
*G09G 3/36* (2006.01)

(52) U.S. Cl.
USPC ..... 345/102; 345/87

(58) Field of Classification Search
USPC ..... 345/87–104
See application file for complete search history.

(56) References Cited

U.S. PATENT DOCUMENTS

| | | | | |
|---|---|---|---|---|
| 7,113,164 | B1 * | 9/2006 | Kurihara | 345/102 |
| 7,199,776 | B2 * | 4/2007 | Ikeda et al. | 345/89 |
| 7,609,248 | B2 * | 10/2009 | Hong et al. | 345/102 |
| 2004/0257329 | A1 * | 12/2004 | Park et al. | 345/102 |
| 2005/0057486 | A1 * | 3/2005 | Aoki et al. | 345/102 |
| 2005/0104841 | A1 * | 5/2005 | Sohn et al. | 345/102 |
| 2005/0174320 | A1 * | 8/2005 | Park | 345/102 |
| 2005/0184952 | A1 * | 8/2005 | Konno et al. | 345/102 |
| 2006/0050047 | A1 * | 3/2006 | Jin et al. | 345/102 |
| 2006/0109234 | A1 * | 5/2006 | Hong et al. | 345/102 |
| 2006/0125771 | A1 * | 6/2006 | Inuzuka et al. | 345/102 |
| 2006/0152469 | A1 * | 7/2006 | Hsu | 345/102 |
| 2006/0208999 | A1 * | 9/2006 | Lee et al. | 345/102 |
| 2006/0267923 | A1 * | 11/2006 | Kerofsky | 345/102 |
| 2007/0216616 | A1 * | 9/2007 | Stessen et al. | 345/84 |
| 2008/0111784 | A1 * | 5/2008 | Tanaka et al. | 345/102 |
| 2009/0115718 | A1 * | 5/2009 | Qiao et al. | 345/102 |

FOREIGN PATENT DOCUMENTS

| | | |
|---|---|---|
| JP | 2002-99250 | 4/2002 |

* cited by examiner

*Primary Examiner* — Alexander Eisen
*Assistant Examiner* — Nelson Lam
(74) *Attorney, Agent, or Firm* — Morgan, Lewis & Bockius LLP

(57) ABSTRACT

A liquid crystal panel includes a plurality of display regions that correspond to the division images. The number of the division images can be set with consideration of the number of lamps covering the display regions. The average brightness of an entire image is compared with the average brightness of the division images so as to vary brightness of each division image according to a comparison result. Light that corresponds to the varied brightness is illuminated to each display region. Therefore, a dark division image is displayed darker and a bright division image is displayed brighter in the image of one frame, thereby enhancing a contrast ratio and reducing power consumption.

9 Claims, 3 Drawing Sheets

LIQUID CRYSTAL DISPLAY DEVICE AND METHOD FOR DRIVING THE SAME

This application claims the benefit of Korean Patent Application No. 10-2004-0116345 filed in Korea on Dec. 30, 2004, which is hereby incorporated by reference.

BACKGROUND OF THE INVENTION

1. Field of the Invention

The present invention relates to a liquid crystal display device (LCD), and more particularly, to an LCD and method for driving the same that are capable of achieving low power consumption and a high contrast ratio.

2. Discussion of the Related Art

In general, an LCD includes a liquid crystal layer interposed between two substrates, and there are two electrodes formed on the respective substrates. The LCD can display a predetermined image by aligning molecules of the liquid crystal layer using an electric field generated by applying a voltage to the two electrodes to adjust light transmittance varied with the alignment of the liquid crystal molecules. The LCD is a passive-type display using light from the outside, not spontaneously generating light. Therefore, the LCD is provided with a backlight unit as a light source for generating light from the outside. The backlight unit may be either an edge type or a direct type depending on the installation position of a lamp thereof.

The edge type backlight unit has a lamp installed around a lateral surface of a light guide plate. The edge type backlight unit is suitable for a small-sized LCD, such as a monitor of a laptop computer, a monitor of a desktop computer or the like. The edge type backlight unit has advantages in light uniformity and durability as well as manufacturing a slim profile LCD.

The direct type backlight unit is suitable for a large-sized LCD requiring high brightness because it has a higher light efficiency than the edge type backlight unit. In the direct type backlight unit, there are a plurality of lamps arranged in one column on a lower surface of a diffusing plate, and light is directly illuminated toward the front surface of a liquid crystal panel.

FIG. 1 is an exploded perspective view illustrating a direct type backlight unit according to the related art. Referring to FIG. 1, the related art direct type backlight unit includes a plurality of fluorescent lamps 1 having phosphors coated on inner surfaces thereof, a cover bottom 3 supporting and fixing the florescent lamps 1, and optical sheets 5*a*, 5*b*, and 5*c* disposed between the fluorescent lamps 1 and a liquid crystal panel (not shown). The optical sheets 5*a*, 5*b*, and 5*c* are designed to prevent the shapes of the fluorescent lamps 1 from being displayed on the liquid crystal panel and to supply light with a uniform brightness distribution on the whole. The optical sheets 5*a*, 5*b* and 5*c* may represent a diffusion sheet, a prism sheet, and a protection sheet, respectively, so as to enhance light scattering effect. A reflector 7 for reflecting light generated from the fluorescent lamps 1 to the liquid crystal panel is disposed inside the cover bottom 3 so as to enhance the efficiency of using light. Electrode connection lines 9*a* and 9*b* to which power is applied are provided on electrodes (not shown) at both ends of the fluorescent lamps 1.

The above-configured backlight unit generates constant brightness regardless of what kind of an image is displayed on the liquid crystal panel. However, the brightness fluctuates even in an image within one frame. Therefore, when a bright image is lightened more or a dark image is darkened more, a contrast ratio should be increased. Since the related art backlight unit always generates the constant brightness regardless of the characteristics of the image, the contrast ratio is deteriorated. In particular, since light with the constant brightness is applied regardless of an image's brightness in the related art, this causes the increase of power consumption. Moreover, it is necessary that an image needing a dark brightness should be displayed by light of a dark brightness and an image needing a bright brightness should be displayed by light of a bright brightness. Accordingly, an apparatus and method for controlling the light brightness according to an image's brightness are in great demand.

SUMMARY OF THE INVENTION

Accordingly, the present invention is directed to a liquid crystal display (LCD) device and method for driving the same that substantially obviate one or more problems due to limitations and disadvantages of the related art.

An object of the present invention is to provide an LCD that is capable of reducing power consumption and enhancing a contrast ratio.

Another of the present invention is to provide a method for driving an LCD that is capable of reducing power consumption and enhancing a contrast ratio.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an LCD includes an LCD panel having a plurality of display regions for displaying a plurality of division images divided from a predetermined image, a controller to control brightness of each of the plurality of division images, and an illuminating portion to illuminate light that corresponds to the brightness of the each of the plurality of division images to each of the plurality of display regions under control of the controller.

In another aspect of the present invention, a method for driving an LCD includes controlling the brightness of a plurality of division images divided from a predetermined image, illuminating light corresponding to brightness of each of the plurality of division images, and displaying each of the plurality of division images using the corresponding light.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
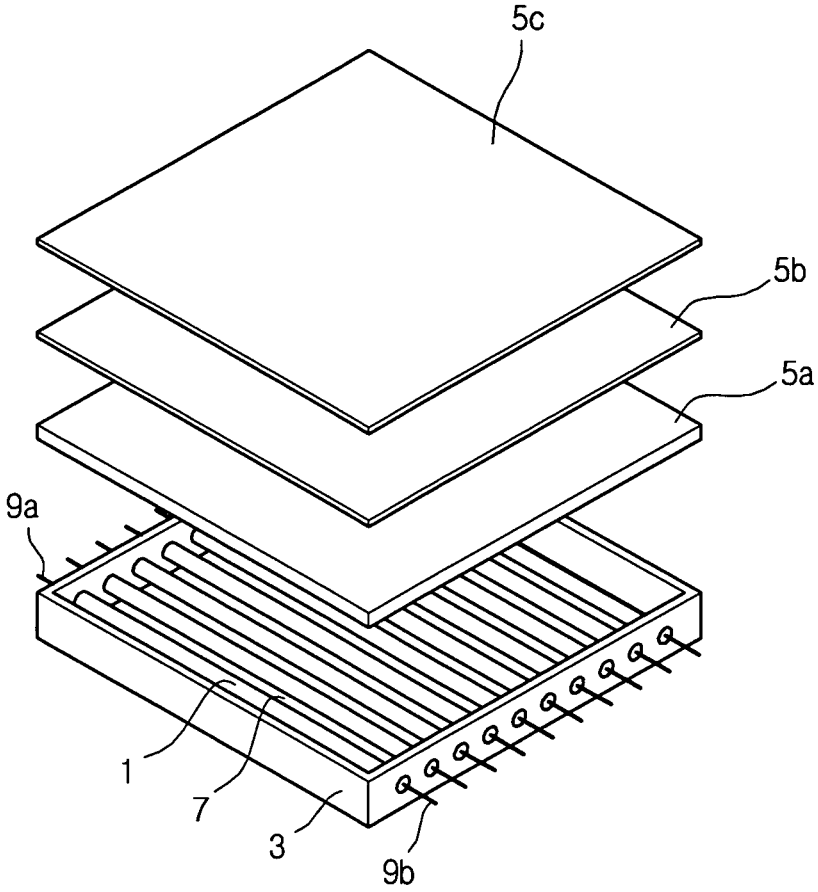
Fig.1 (Related Art)
FIG. 1 is an exploded perspective view illustrating a direct type backlight unit according to the related art.
Figure 2:
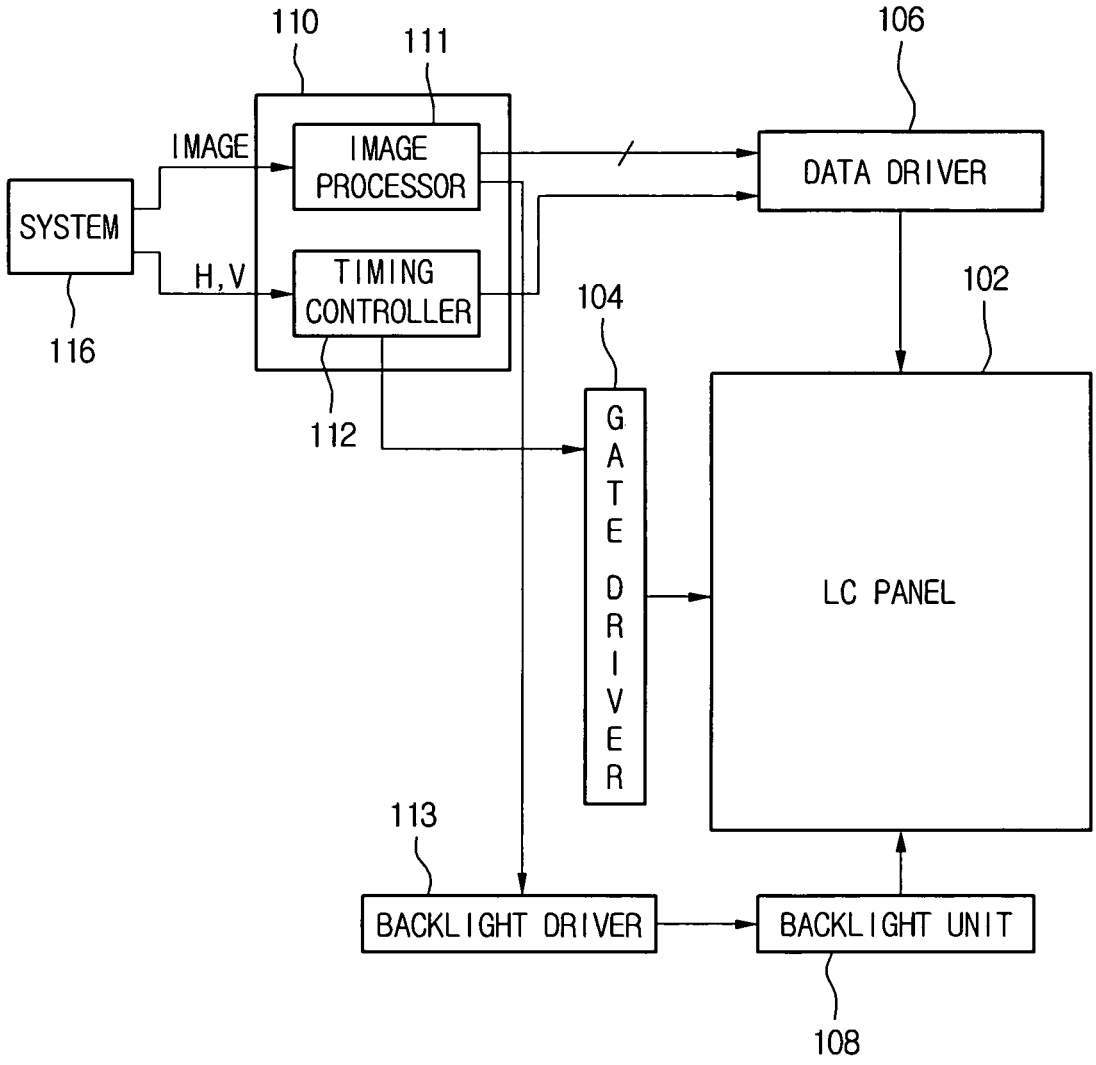
FIG. 2 is a view schematically illustrating a liquid crystal display (LCD) device according to one exemplary embodiment of the present invention.

FIG. 2 is a view schematically illustrating a liquid crystal display (LCD) according to one exemplary embodiment of the present invention. As shown in FIG. 2, the LCD includes a liquid crystal panel 102 for displaying an image, a gate driver 104 and a data driver 106 for driving the liquid crystal panel 102, a controller 110 for controlling the gate driver 104 and the data driver 106 to supply a predetermined data signal to the liquid crystal panel 102, a backlight driver 113 for controlling a backlight unit 108 using a drive signal generated from the controller 110, and the backlight unit 108 for generating predetermined light under control of the backlight driver 113.

Although not shown, the liquid crystal panel 102 includes pixels arranged in a matrix type and thin film transistors (TFTs) formed on intersections of gate lines and data lines. The gate driver 104 sequentially supplies a scan signal to the gate lines of the liquid crystal panel 102 in response to a gate control signal supplied from the controller 110. The TFT connected to the gate line is driven in unit of one gate line by the scan signal. The data driver 106 supplies data signals in increment of one line each over respective horizontal periods according to a data control signal supplied from the controller 110.

The controller 110 includes a timing controller 112 controlling the gate driver 104 and the data driver 106, and an image processor 111 supplying a data signal to the data driver 106 and a driving signal to the backlight driver 113. The timing controller 112 generates a gate control signal controlling the gate driver 104 and a data control signal controlling the data driver 106 using a horizontal synchronization signal Hsync (H) and a vertical synchronization signal Vsync (V) supplied from a system 116. The image processor 111 supplies the data signal to the data driver 106 on the basis of a predetermined image supplied from the system 116. The data signal denotes a digital signal. Also, the image processor 111 generates the drive signal for allowing lamps (i.e., CCFL, EEFL or LED) contained in the backlight unit 108 to be differently driven for each division image.

The backlight driver 113 drives the backlight unit 108 according to the drive signal supplied from the image processor 111. Although not shown, the backlight unit 108 includes a plurality of lamps (e.g., CCFLs, EEFLs or LEDs), a cover bottom for fixing and supporting the lamps, optical sheets disposed between the lamps and the liquid crystal panel 102. The intensity of light from each lamp contained in the backlight unit 108 may be determined by a lamp current flowing through the inside of the backlight unit 108.

Figure 3:
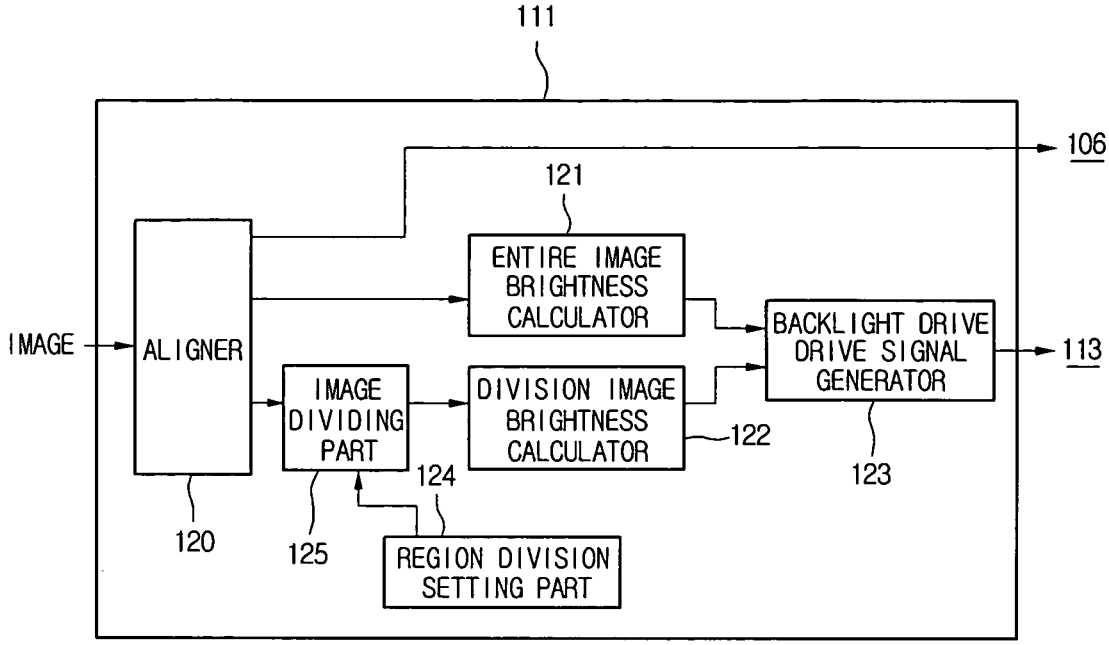
FIG. 3 is a detailed view illustrating an image processor of the LCD device of FIG. 2.

FIG. 3 is a view illustrating in detail the image processor 111 of the LCD of FIG. 2. As shown in FIG. 3, the image processor 111 includes an aligner 120 for aligning a predetermined image supplied from the system 116 as an image of one frame, an entire image brightness calculator 121 for calculating average brightness of the entire image of the one frame supplied from the aligner 120, a region division setting part 124 for generating a division region set for the image according to an arrangement of the plurality of lamps provided to the backlight unit 108, an image dividing part 125 for dividing the image according to the division region set from the region division setting part 124, a division image brightness calculator 122 for calculating average brightness of each division image divided by the image dividing part 125, a backlight drive signal generator 123 for comparing the average brightness of the entire image calculated from the entire image brightness calculator 121 with the average brightness of the division image calculated by the division image brightness calculator 122 to generate a backlight drive signal.

The aligner 120 aligns images supplied from the system 116 in unit of one frame and supplies the images to the data driver 106. Also, the aligner 120 supplies the image of one frame to the entire image brightness calculator 121 and to the image dividing part 125. The entire image brightness calculator 121 calculates the average brightness of the entire image of unit of one frame. For example, the entire image brightness calculator 121 calculates the brightness of the entire image of unit of one frame and divides the calculated brightness of the entire image by the number of pixels contained in one frame, thereby obtaining the average brightness thereof.

The region division setting part 124 sets the number of the lamps (e.g., CCFLs, EEFLs or LEDs) that correspond to the division region of one frame image with reference to the lamps provided to the backlight unit 108. For example, twelve lamps are used to display one frame image, and may be set as three division regions. That is, four lamps correspond to each unit division region. Such image division setting may be performed by any user from the outside.

One frame image supplied from the aligner 120 is divided according to the number of the division images set by the region division setting part 124. The backlight drive signal generator 123 compares the average brightness of the entire image calculated from the entire image brightness calculator 121 with the average brightness of the division image calculated by the division image brightness calculator 122 to supply a backlight drive signal that corresponds to each division image to the backlight driver 113 according to the comparison results. For example, when the average brightness of the division image is greater (i.e., brighter) than the average brightness of the entire image, the backlight drive signal generator 123 generates a backlight drive signal to the backlight driver 113. The backlight driver 113 generates a driving voltage, which corresponds to the average brightness of the division image, to maintain or increase the average brightness of the division image. On the other hand, when the average brightness of the division image is smaller (i.e., darker) than the average brightness of the entire image, the backlight drive signal generator 123 generates a backlight drive signal to the backlight driver 113. The backlight driver 113 generates a driving voltage, which corresponds to brightness lower than the average brightness of the division image, such that the division image may have brightness lower than the average brightness of the division image.

Accordingly, when the average brightness of the division image is brighter than the average brightness of the entire image, the backlight drive signal generator 123 controls the backlight driver 113 to maintain or increase the brightness of the division image. When the average brightness of the division image is darker than the average brightness of the entire image, the backlight drive signal generator 123 controls the backlight driver 113 to make the brightness of the division image smaller than the average brightness of the division image.

In response to a backlight drive signal supplied from the backlight drive signal generator 123, the backlight driver 113 generates the driving voltage that corresponds to the backlight drive signal. Specifically, the backlight driver 113 generates a different voltage for each division image in response to a backlight drive signal supplied from the backlight drive signal generator 123. The backlight driver 113 may include an inverter (not shown). When the backlight drive signal is supplied to the inverter, the inverter generates a driving voltage that corresponds to the backlight drive signal. Therefore, since a dark division image is displayed darker, a bright division image is displayed brighter than the dark division image, thereby increasing a contrast ratio. Also, as the dark division image is made darker, the intensity of light from the lamps located in a region that corresponds to the dark division image is controlled, thereby reducing the power consumption.

Moreover, the backlight drive signal generator 123 compares the average brightness of an image displayed on the division regions with the average brightness of the entire image. When the average brightness of the division image is greater than the average brightness of the entire image, the backlight drive signal generator 123 generates a backlight drive signal for generating a driving voltage that corresponds to brightness greater than the brightness of the division image such that the brightness of the division image is greater than the average brightness of the division image.

As described above, the present invention divides one frame image according to the number of the lamps provided to the backlight unit, compares the average brightness of each division image with the average brightness of the entire image, and allows a different driving voltage to be supplied according to the average brightness of the each division image, thereby increasing the contrast ratio and reducing the power consumption.

It will be apparent to those skilled in the art that various modifications and variations can be made in the LCD device and method of driving the same of the present invention. Thus, it is intended that the present invention covers the modifications and variations of this invention provided they come within the scope of the appended claims and their equivalents.

What is claimed is:

1. A liquid crystal display (LCD) device, comprising:

a backlight unit having a plurality of division regions, each division region corresponding to a plurality of light sources;

an LCD panel for displaying a plurality of division images divided from an entire image of one frame, the division images corresponding to the division regions, respectively;

an image dividing part to divide the entire image of one frame into the plurality of division images corresponding to the number of the division regions;

a first calculator to calculate average brightness of the entire image of one frame;

a second calculator to calculate average brightness of each division image;

a backlight drive signal generator to compare the average brightness of the entire image of one frame with the average brightness of each division image and to generate a plurality of backlight drive signals for adjusting brightness of the plurality of division regions within one frame according to the comparing result; and a backlight driver to generate a plurality of backlight drive voltages for adjusting the brightness of the plurality of division regions in response to the plurality of backlight drive signals such that light having the adjusted brightness is emitted from the plurality of light sources included in each division region, wherein the backlight drive signal generator generates a backlight drive signal for adjusting a brightness brighter than or the same as the average brightness of the division image when the average brightness of the division image is greater than the average brightness of the entire image of one frame.

2. The LCD according to claim 1, further comprising a division setting part to set the number of the plurality of division images.

3. The LCD according to claim 2, wherein the division setting part sets the number of the plurality of division regions.

4. The LCD according to claim 1, wherein the backlight driver includes an inverter to generate a backlight driving voltage according to the brightness of the each of the plurality of division images.

5. The LCD according to claim 1, wherein the light sources comprise a plurality of CCFLs, EEFLs or LEDs.

6. A method for driving an LCD having a backlight unit having a plurality of division regions, each division region corresponding to a plurality of light sources, and an LCD panel for displaying a plurality of division images divided from an entire image of one frame, the division images corresponding to the division regions, respectively, comprising:

dividing the image of one frame into the plurality of division images corresponding to the number of the division regions;

calculating average brightness of the entire image of one frame;

calculating average brightness of each division image;

comparing the average brightness of the entire image of one frame with the average brightness of each division image and generating a plurality of digital backlight drive signals for adjusting brightness of the division regions within one frame according to the comparing result;

generating a plurality of backlight drive voltages for adjusting the brightness of the plurality of division regions in response to the plurality of backlight drive signals; and emitting light having the adjusted brightness from the plurality of light sources included in each division region and providing the light having the adjusted brightness to the LCD panel, wherein the step of generating a plurality of digital backlight drive signals includes generating a backlight drive signal for adjusting a brightness brighter than or the same as the average brightness of the division image when the average brightness of the division image is greater than the average brightness of the entire image of one frame.

7. The method according to claim 6, further comprising setting the number of the division regions.

8. The method according to claim 7, wherein the light sources comprise a plurality of CCFLs or EEFLs or LEDs.

9. A liquid crystal display (LCD) device, comprising:

a backlight unit having a plurality of division regions, each division region corresponding to a plurality of light sources;

an LCD panel for displaying a plurality of division images divided from an entire image of one frame, the division images corresponding to the division regions, respectively;

an image dividing part to divide the entire image of one frame into the plurality of division images corresponding to the number of division regions;

a first calculator to calculate average brightness of the entire image of one frame;

a second calculator to calculate average brightness of each division image;

a backlight drive signal generator to compare the average brightness of the entire image of one frame with the average brightness of each division image and to generate a plurality of backlight drive signals for adjusting brightness of the plurality of division regions within one frame according to the comparing result; and a backlight driver to generate a plurality of backlight drive voltages for adjusting the brightness of the plurality of division regions in response to the plurality of backlight drive signals such that light having the adjusted brightness is emitted from the plurality of light sources included in each division region, wherein the backlight drive signal generator generates a backlight drive signal for adjusting a brightness darker than the average brightness of the division image when the average brightness of the division image is smaller than the average brightness of the entire image of one frame.

* * * * *